US009985333B2

(12) United States Patent
Takeuchi et al.

(10) Patent No.: US 9,985,333 B2
(45) Date of Patent: May 29, 2018

(54) WINDOW GLASS FOR VEHICLE AND GLASS ANTENNA

(71) Applicant: ASAHI GLASS COMPANY, LIMITED, Tokyo (JP)

(72) Inventors: Shoichi Takeuchi, Tokyo (JP); Naoki Hashimoto, Tokyo (JP)

(73) Assignee: ASAHI GLASS COMPANY, LIMITED, Tokyo (JP)

( * ) Notice: Subject to any disclaimer, the term of this patent is extended or adjusted under 35 U.S.C. 154(b) by 37 days.

(21) Appl. No.: 15/148,524

(22) Filed: May 6, 2016

(65) Prior Publication Data

US 2016/0344088 A1 Nov. 24, 2016

(30) Foreign Application Priority Data

May 22, 2015 (JP) ..... 2015-104922
Apr. 4, 2016 (JP) ..... 2016-075295

(51) Int. Cl.

| | |
|---|---|
| ***H01Q 1/12*** | (2006.01) |
| ***H01Q 5/371*** | (2015.01) |
| ***H01Q 21/28*** | (2006.01) |
| ***H01Q 1/48*** | (2006.01) |

(52) U.S. Cl.

CPC ..... *H01Q 1/1271* (2013.01); *H01Q 1/48* (2013.01); *H01Q 5/371* (2015.01); *H01Q 21/28* (2013.01)

(58) Field of Classification Search

CPC ..... H01Q 1/1271
See application file for complete search history.

(56) References Cited

U.S. PATENT DOCUMENTS

| | | | | |
|---|---|---|---|---|
| 5,663,737 | A * | 9/1997 | Kakizawa | H01Q 1/1271 343/704 |
| 6,072,435 | A * | 6/2000 | Terashima | H01Q 1/1271 343/704 |
| 2008/0169989 | A1* | 7/2008 | Li | H01Q 1/1271 343/713 |
| 2009/0140938 | A1* | 6/2009 | Ishibashi | H01Q 1/1271 343/713 |

(Continued)

FOREIGN PATENT DOCUMENTS

| | | |
|---|---|---|
| DE | 10 2012 111 571 A1 | 6/2014 |
| EP | 0 851 527 A2 | 7/1998 |

(Continued)

*Primary Examiner* — Robert Karacsony
(74) *Attorney, Agent, or Firm* — Foley & Lardner LLP

(57) ABSTRACT

There is provided a window glass for a vehicle, the window glass including a glass antenna for transmitting and receiving communication waves. The glass antenna includes a pair of electrodes that are a ground electrode and a power feeding electrode; a first antenna element connected to the power feeding electrode; a second antenna element connected to the power feeding electrode, the second antenna element extending downward; a third antenna element connected to the power feeding electrode, the third antenna element extending in a direction that differs from that of the second antenna element; a fourth antenna element, one end of the fourth antenna element being connected to an end portion of the third antenna element; and a fifth antenna element, one end of the fifth antenna element being connected to the end portion of the third antenna element and the one end of the fourth antenna element.

12 Claims, 13 Drawing Sheets

(56) References Cited

U.S. PATENT DOCUMENTS

| | | | | |
|---|---|---|---|---|
| 2011/0037668 | A1* | 2/2011 | Mukai | H01Q 1/1271<br>343/712 |

FOREIGN PATENT DOCUMENTS

| | | | | |
|---|---|---|---|---|
| EP | 0 963 002 | A1 | | 12/1999 |
| EP | 2 712 020 | A1 | | 3/2014 |
| EP | 2 800 204 | A1 | | 11/2014 |
| JP | 2012-054915 | A | | 3/2012 |
| JP | 2013026828 | A | * | 2/2013 |
| WO | WO-2014/104365 | A1 | | 7/2014 |

* cited by examiner

WINDOW GLASS FOR VEHICLE AND GLASS ANTENNA

CROSS-REFERENCE TO RELATED APPLICATION

The present application is based on and claims the benefit of priority of Japanese Priority Applications No. 2015-104922 filed on May 22, 2015, and No. 2016-075295 filed on Apr. 4, 2016, the entire contents of which are hereby incorporated by reference.

BACKGROUND OF THE INVENTION

1. Field of the Invention

The present invention relates to window glass for a vehicle, and a glass antenna. The window glass includes the glass antenna for transmitting and receiving communication waves.

2. Description of the Related Art

Recently, with the development of communication technology, a mobile device is carried in a vehicle to execute communication between the vehicle and the mobile device, and between the vehicle and outside the vehicle.

Further, technology of a so-called connected car has been proposed that includes a function of the vehicle itself to collect information from outside, and a function of the vehicle itself to deliver information. With a connected car, by bi-directionally communicating, for example, data transmitted from the vehicle, such as location information, a vehicle condition, and a road condition; and map information, traffic information, and weather information collected from outside; telematics service can be provided, such as traffic congestion mitigation and driving assist for enhancing efficiency and safety of the vehicle. Furthermore, it is expected that, with the connected car, solution/services, etc., can be provided, such as music and video delivery services, as a tool (device) to enhance convenience of a user.

For such communication waves that are used for bi-directional communication, used frequencies differ depending on countries, and in a specific country, used frequency bands differ depending on operators. Thus, an antenna that supports a wide band is preferable, so that a plurality of communication waves can be received.

Here, as illustrated in FIG. 1, a technique has been proposed to install a communication antenna on a roof of the vehicle, so that a bi-directional communication function between the vehicle and outside the vehicle can be achieved.

In the example illustrated in FIG. 1, an antenna unit 80 having a diversity structure that includes a first antenna 81 and a second antenna 82, which are installed to stand on a ground plate 83 while separated in the longitudinal direction (front-back direction) of the vehicle 90, is installed on a roof 91 of a vehicle 90. These antennas 81 and 82 are built into a case 84.

Additionally, for a vehicle, various types of technology of a glass antenna, which is window glass including an antenna function, have been proposed to receive radio or television signals. For example, a glass antenna 70 according to Patent Document 2, which is illustrated in FIG. 2, can receive digital audio broadcast signals.

Patent Document

[Patent Document 1] Japanese Unexamined Patent Publication No. 2012-054915

[Patent Document 2] WO 2014-104365

SUMMARY OF THE INVENTION

In the example of Patent Document 1, the antenna unit 80 protrudes from the roof 91, so that the antenna unit 80 may affect the design of the vehicle and aerodynamic characteristics of the vehicle.

Additionally, as described in Patent Document 2, it is assumed that glass antennas that are commonly installed these days receive broadcast waves, and communication waves do not use such antennas.

In view of the above-described circumstances, an object of the present invention is to provide window glass with a glass antenna that enhances appearance, and that enables communication in a wide band; and to provide the glass antenna for communication.

According to an aspect of the present invention, there is provided a window glass for a vehicle, the window glass including a glass antenna for transmitting and receiving communication waves. The glass antenna includes a pair of electrodes that are a ground electrode and a power feeding electrode; a first antenna element that is connected to the power feeding electrode; a second antenna element that is connected to the power feeding electrode, and that extends approximately downward, wherein the second antenna element is longer than the first antenna element; a third antenna element that is connected to the power feeding electrode, and that extends in a direction other then the direction in which the second antenna element extends, wherein the third antenna element is shorter than the second antenna element; a fourth antenna element, wherein one end of the fourth antenna element is connected to an end portion of the third antenna element, and the other end of the fourth antenna element extends upward; and a fifth antenna element, wherein one end of the fifth antenna element is connected to the end portion of the third antenna element and the one end of the fourth antenna element, and the other end of the fifth antenna element extends downward.

According to an embodiment of the present invention, an appearance of window glass for a vehicle including a glass antenna can be enhanced, and the glass antenna allows communication in a wide band.

BRIEF DESCRIPTION OF THE DRAWINGS

Other objects, features and advantages of the present invention will become more apparent from the following detailed description when read in conjunction with the accompanying drawings.

DETAILED DESCRIPTION OF THE PREFERRED EMBODIMENTS

Figure 1:
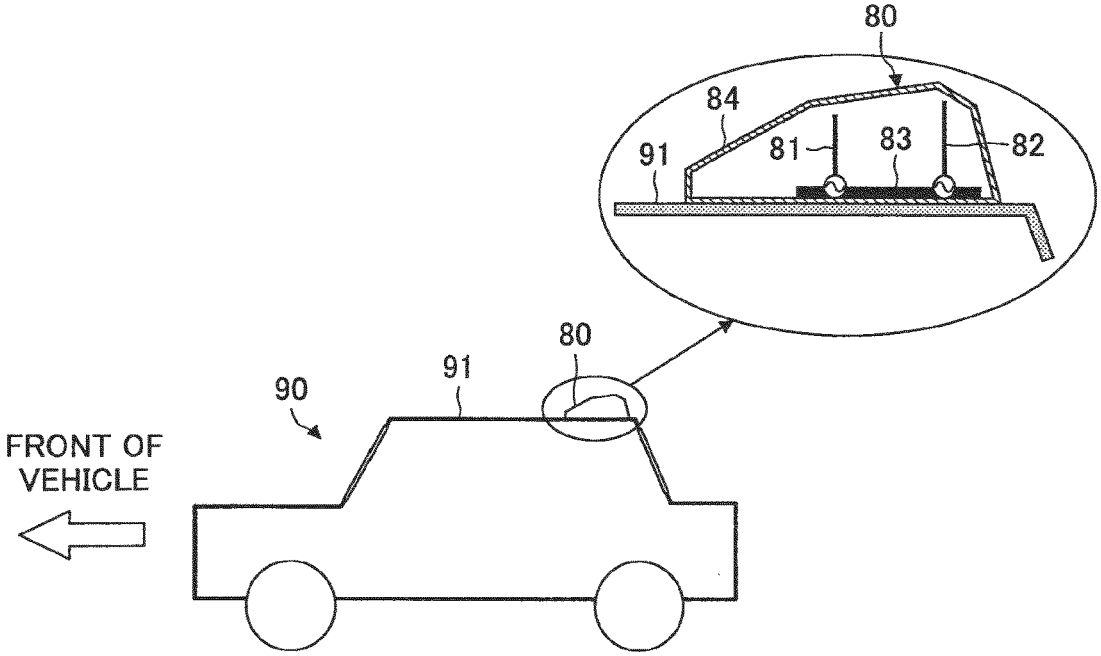
FIG. 1 is a diagram illustrating a whole vehicle in which a usual communication antenna is installed.
Figure 2:
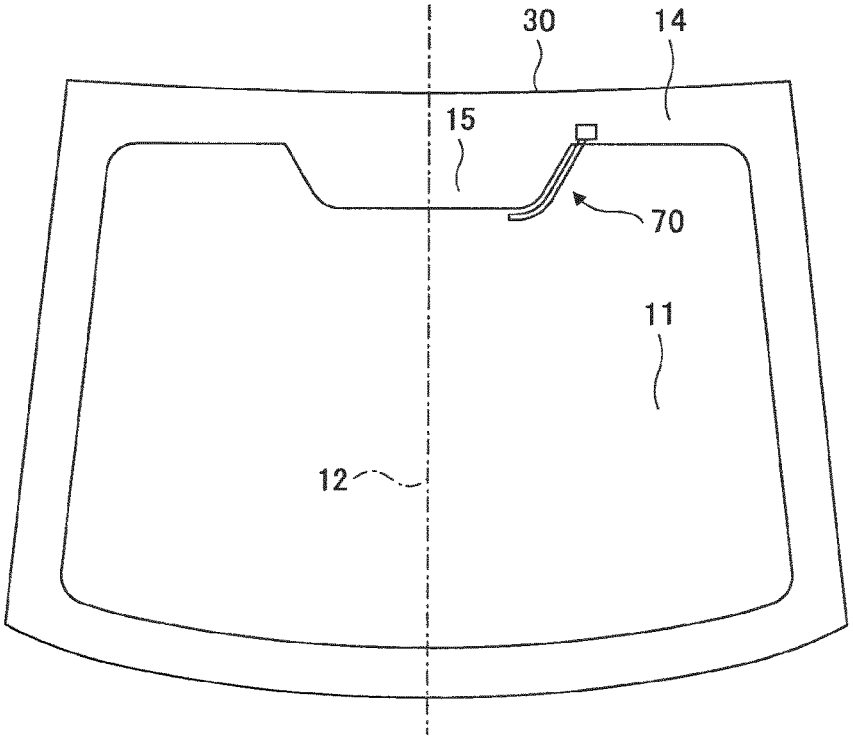
FIG. 2 is a diagram illustrating window glass for a vehicle in which a usual broadcast receiving antenna is installed.

An embodiment for implementing the present invention is described below by referring to the accompanying drawings. Note that, in the drawings for describing the embodiment, it is assumed that, if a direction is not particularly described, the direction refers to the direction on the drawings. The drawings represent views when a surface of window glass is viewed while facing the surface, i.e., the drawings represent views when the window glass is installed in a vehicle, and when the window glass is viewed from inside the vehicle (or from outside the vehicle). In the drawings, the left/right direction (the lateral direction) corresponds to the horizontal direction, and the up/down direction corresponds to the vertical direction.

However, the drawings may be referred to as the views when the window glass is viewed from outside the vehicle. For example, if the window glass is a windshield that is installed in a front part of the vehicle, the left/right direction on the drawings corresponds to a vehicle width direction. Further, the window glass according to the embodiment of the present invention is not limited to the windshield, and the window glass may be rear glass that is installed in a rear part of the vehicle, or side glass that is installed in a side part of the vehicle. Further, for directions, such as a parallel direction and a perpendicular direction, a deviation may be allowed to the extent that the effect of the present invention is maintained.

Further, in the embodiment of the present invention, window glass is an example of a window plate that covers an opening of a vehicle body. The material of the window plate is not limited to glass; and the material of the window plate may be a resin, or a film, for example. The window glass 11 is installed at a body flange, which is formed in the vehicle body (a vehicle body opening, or a body flange) 30. The outer peripheral edges 11*a*, 11*b*, 11*c*, and 11*d* of the window glass 11 are depicted by the dashed line in FIG. 3. The vehicle body 30 includes the edge parts 30*a*, 30*b*, 30*c*, and 30*d* of the body flange, which forms a window opening of the vehicle body.

Figure 3:
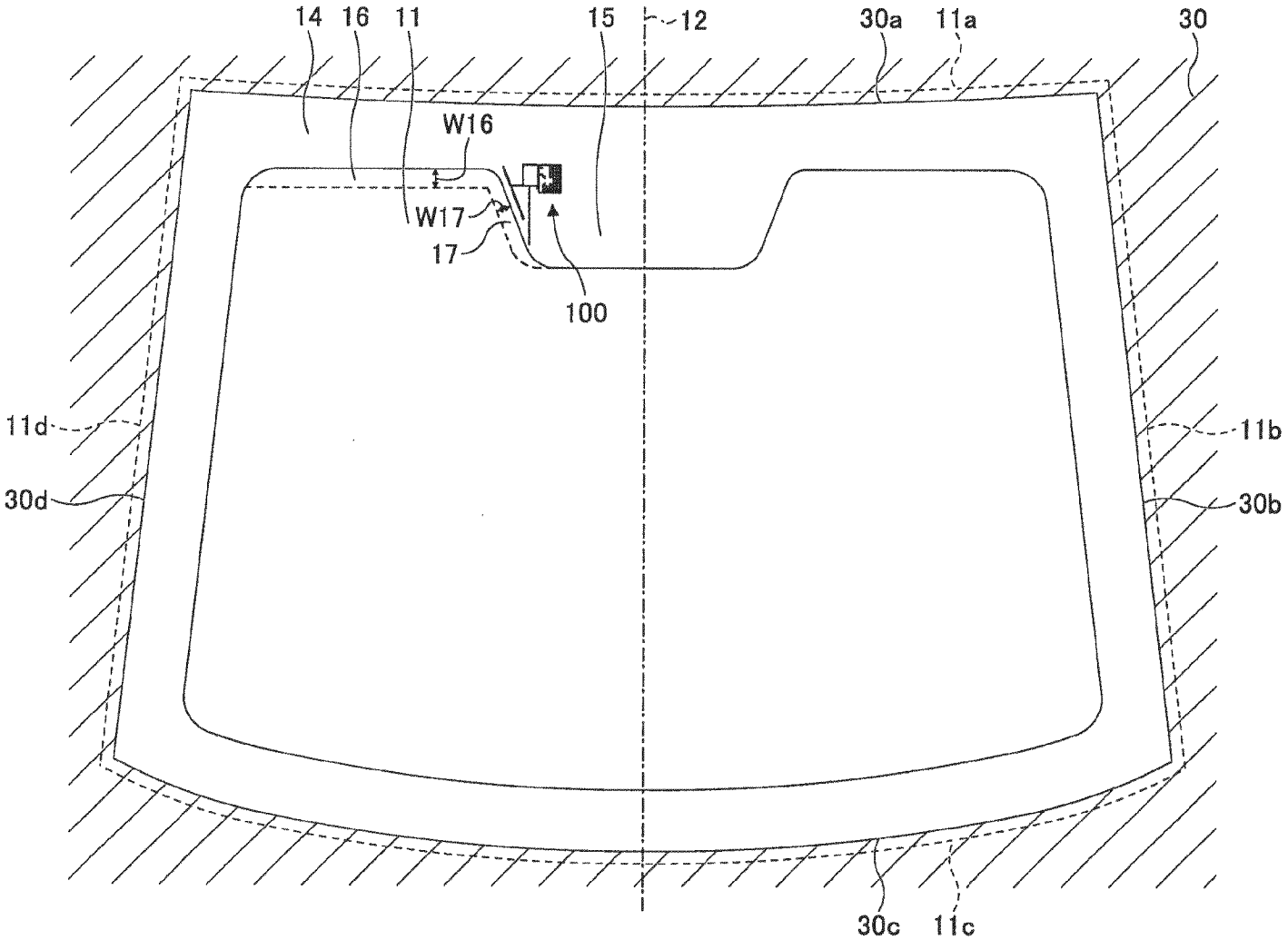
FIG. 3 is a plane view illustrating a whole wind shield in which a communication glass antenna according to an embodiment of the present invention is installed.

FIG. 3 is a plan view of the glass antenna (an example of a vehicle glass antenna) 100 according to the embodiment of the present invention. The vehicle glass antenna (an antenna incorporated in the window plate by printing, embedding, or pasting, for example) 100 is formed of the vehicle window glass (the window plate, or the windshield) 11. Here, the vehicle window glass 11 includes electrodes, which are provided as planer conductor patterns; and antenna conductors.

Figure 4:
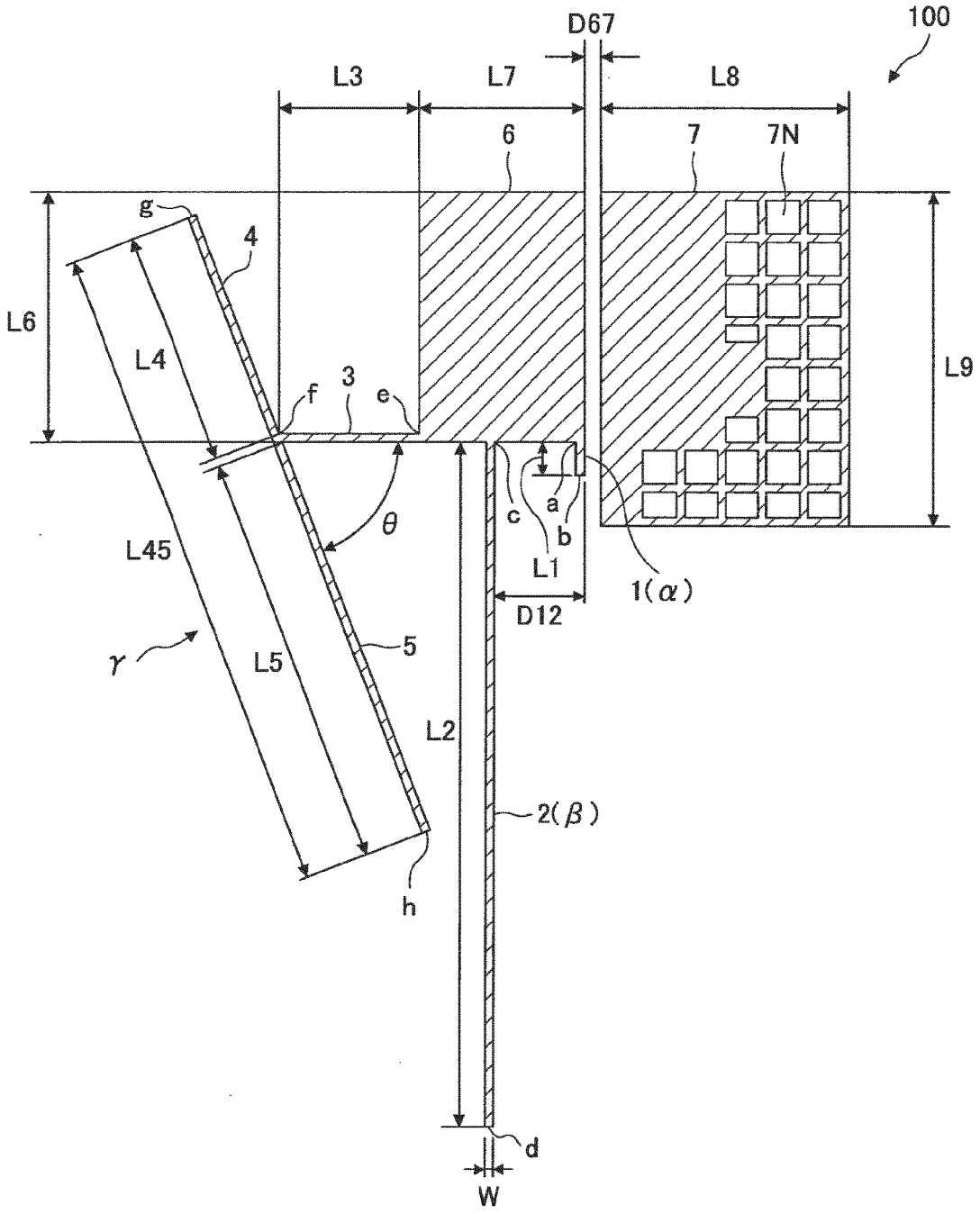
FIG. 4 is a diagram magnifying and illustrating the communication glass antenna according to the embodiment

FIG. 4 is a diagram magnifying and illustrating the glass antenna 100 according to the embodiment, which is to be installed in vehicle window glass. The glass antenna 100 includes a pair of electrodes (a power feeding electrode 6, and a ground electrode 7); a first antenna element 1 (an antenna conductor α) connected to the power feeding electrode 6; a second antenna element 2 (an antenna conductor β) connected to the power feeding electrode 6, the second antenna element 2 being longer than the first antenna element 1, and the second antenna element 2 extending (stretching) in an approximately downward direction; and an antenna conductor γ connected to the power feeding electrode 6, the antenna conductor γ having three line-shaped elements.

The antenna conductor γ includes a line-shaped element 3 (a third antenna element) connected to the power feeding electrode 6, the line-shaped element 3 extending in a direction that is different from the direction of the second element 2; a line-shaped element 4 (a fourth antenna element), one end of the line-shaped element 4 being connected to an end portion of the line-shaped element 3, and the other end of the line-shaped element 4 extending in an approximately upward direction; and a line-shaped element 5 (a fifth antenna element), one end of the line-shaped element 5 being connected to the end portion of the line-shaped element 3 and to the one end of the line-shaped element 4, and the other end of the line shaped element 5 extending in the approximately downward direction.

Here, approximately upward means that the end is in the upward direction with respect to the other end portions; and approximately upward includes upward in a vertical direction and obliquely upward. Approximately downward means that the end is in the downward direction with respect to the other end portions; and approximately downward includes downward in a vertical direction and obliquely downward.

Note that a corner of the antenna conductor may be bent with a curvature. Further, the end portion may be the end edge of extension of each of the antenna elements 1 to 5; or the end portion may be a conductor portion, which is next to the end portion, in the vicinity of the end edge.

In FIG. 3, a black or brown shielding film 14 may be formed on a peripheral region on the surface of the window glass for the windshield, and a portion of or all the antenna conductor may be formed on the shielding film 14. For the shielding film 14, ceramics may be used, such as a black ceramics film.

Further, the shielding film 14 is provided with a protruding portion 15 (the protruding portion of the shielding film) in the vicinity of a center line 12, which is depicted in the figure by a chain line, in the width direction of the window glass 11, so that a camera 21 (cf. FIGS. 13-17) etc., which is described later, can be disposed. Both side edges of the protruding portion 15 are formed in respective oblique directions, so that the distance between the side edges becomes small toward a central area of the window glass 11, for example. In the embodiment, an angle formed between the centerline 12 of the window glass 11, which is the windshield, and each of the extended lines of the side edges is assumed to be greater than or equal to 0 degrees and less than or equal to 85 degrees.

The protruding portion 15, which includes shielding dot portions 16 and 17 described below, is formed to have a width that is approximately one third with respect to the total width of the window glass 11, for example. Specifically, the trapezoidal protruding portion 15 that is convex downward may be formed, so that an upper edge is approximately from 260 mm to 660 mm; a lower edge is approximately from 140 mm to 540 mm; and the height of the protruding portion 15 is approximately from 130 mm to 260 mm.

Further, the shielding dot portion 16 that extends in the horizontal direction is formed at a lower portion of the edge portion of the shielding film 14; and the shielding dot portion 17 that extends in the vertical direction is formed at an edge portion (the side edge) of the protruding portion 15 toward a central area of the window glass 11. Each of the shielding dot portions 16 and 17 is formed of a plurality of dots, and has a predetermined width, so that each of the shielding dot portions 16 and 17 gradually becomes thin (so as to form gradation) by gradually reducing the size of the dots and/or by gradually increasing the distance between the dots from the central portion of the protrusion 15 toward outside (from top to bottom). For example, the shielding dot portion 16 extending in the horizontal direction is formed, so that the width 16 of the shielding portion 16 is approximately 3 mm to 20 mm; and the shielding dot portion 17 extending in the vertical direction is formed, so that the width 17 of the shielding portion 17 is approximately 15 mm to 30 mm.

Note that, in one half of the protruding portion 15 (the right half in FIG. 3) where the glass antenna 100 and a cover, etc., which is described below, are not installed, the entire protruding portion 15 of the shielding portion 14 may be formed as a dot portion.

In the embodiment, if the window glass 11 is viewed from outside the vehicle, the electrodes and the conductor portions of the antenna, which are formed on the shielding film 14 when the window glass 11 is viewed from inside the vehicle, are invisible from outside the vehicle due to the shielding film 14, whereby the window glass having superior design can be obtained. In the depicted configuration, by forming, on the protruding portion 15 of the shielding film 14, at least one part of the pair of electrodes 6 and 7, the first antenna element 1, the second antenna element 2, and the third antenna element 3, only a thin linear portion of the conductor (a portion of the antenna conductor γ) can be viewed from outside the vehicle, so that it is preferable for designing.

The glass antenna 100 is configured, so that the power feeding electrode 6 may preferably be disposed in the vicinity of a vehicle body 30, e.g., an upper edge portion 30*a* of the vehicle body formed of a metal.

Figure 17:
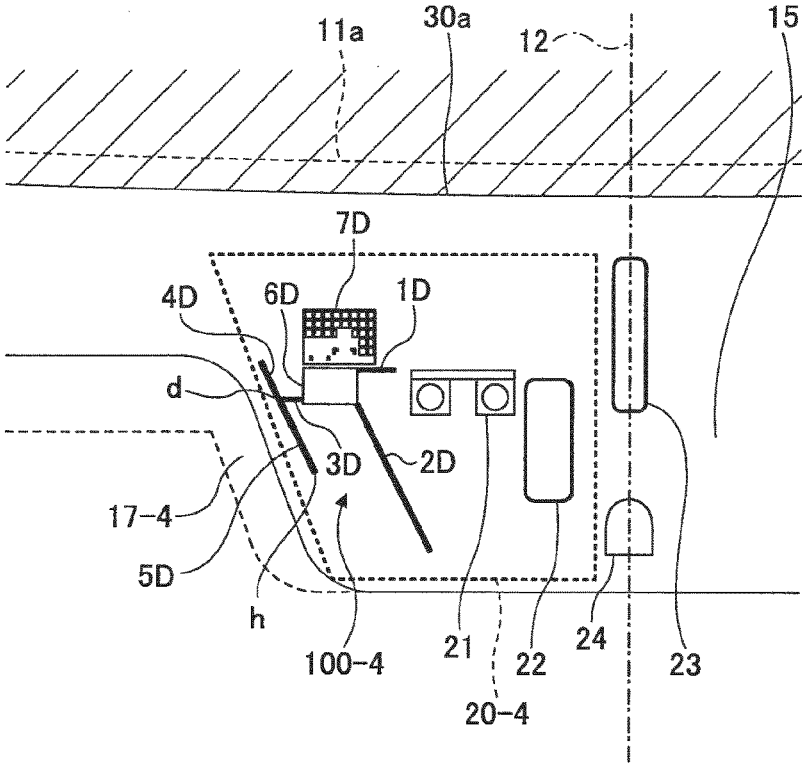
FIG. 17 is a plane view illustrating a part of the window shield in which the glass antenna according to another embodiment, the camera, and the rain sensor are installed while covered with the cover.

FIG. 4 illustrates the rectangular power feeding electrode 6. A connecting point "a" for connecting the power feeding electrode 6 to the first antenna element 1 and a connecting point "c" for connecting the power feeding electrode 6 to the second antenna element 2 are positioned at respective end portions of the lower edge of the power feeding electrode 6. Alternatively, as illustrated in FIG. 17, a first antenna element 1D and a second antenna element 2D may be connected to a right edge of a power feeding electrode 6D, details of which are described below. Alternatively, in the horizontal direction, the first antenna element 1 may extend from the left edge, and the second antenna element 2 may extend from the right edge in a direction opposite to the direction in which the first antenna element 1 extends.

As described below, in the embodiment of the present invention, a glass antenna may be obtained by providing a conductor layer formed of antenna conductors inside a synthetic resin film or on a surface of the synthetic resin film, and by installing the synthetic resin film with the conductor layer on a surface of the window glass facing inside the vehicle or on a surface of the window glass facing outside the vehicle. Additionally, a glass antenna may be obtained by installing, on a surface of a window glass plate facing inside the vehicle or on a surface of the window glass plate facing outside the vehicle, a dielectric flexible circuit board in which the antenna conductor is formed.

Further, an "end portion" of an element may be a start point or an end point of extension of the element; or the "end portion" of the element may be a conductor portion, which is next to the start point, in the vicinity of the start point, or a conductor portion, which is next to the end point, in the vicinity of the end point. Furthermore, a connecting portion connecting elements may be bent with a curvature.

The antenna conductor is formed by printing and baking paste including an electrically conductive metal, such as silver paste, on the surface of the window glass facing inside the vehicle. However, a method of forming the antenna conductor is not limited to this method. A linear body or a foil-shaped body formed of a conductive material, such as copper, may be formed on the surface of the window glass facing inside the vehicle or facing outside the vehicle. The linear body or the foil-shaped body may be formed on the window glass by using an adhesive, or the linear body or the foil-shaped body may be formed inside the window glass. The same applies to the power feeding electrode 6 and the ground electrode 7.

Here, if the vehicle body 30 is formed of a metal, as a position where a radiating element of an antenna is disposed becomes closer to the vehicle body 30 on the window glass 11, the antenna reception gain tends to be lower, due to the interference with the metal.

In the embodiment of the present invention, even if any one of the examples illustrated in FIGS. 13 to 17 are used, the second antenna element 2, which is the longest linear element, is connected to the lower edge (bottom) of the power feeding electrode 6. Consequently, the second antenna element 2, which is the longest, and which most significantly affects the performance of the glass antenna 100 among antenna conductors of the glass antenna 100, is separated from the upper edge portion 30*a* of the vehicle body 30 at least by a predetermined distance.

Specifically, the area where the vehicle antenna is disposed is in the vicinity of the upper edge portion 11*a* of the window glass 11, and in a range within 25% of the length of the opening from the upper edge portion 30*a* in the vertical direction. The distance between the upper edge portion 30*a* to the area where the vehicle antenna is disposed may preferably be less than or equal to 250 mm; more preferably less than or equal to 100 mm; and further more preferably less than or equal to 70 mm.

Furthermore, the glass antenna 100 may preferably be separated not only from the upper edge portion 30*a* of the vehicle body 30, but also from a side edge portion 30*b* of the vehicle body 30 by the predetermined distance, so as to avoid the interference with the metal of the vehicle body 30. Thus, the glass antenna 100 is disposed in the vicinity of the center line 12 of the window glass 11.

<Embodiment>

In the embodiment illustrated in FIG. 4, the glass antenna 100 includes the antenna conductor α; the antenna conductor β; and the antenna conductor γ, which are extended from the power feeding electrode 6.

In the embodiment of the present invention, the first antenna element 1 that forms the antenna conductor α extends, substantially in the vertical direction toward a side separated from the upper edge portion 30*a*, from the connecting point "a" for connecting the first antenna element 1 to the power feeding electrode 6, as a starting point, to a lower end "b," which is an end point. The second antenna element 2 that forms the antenna conductor R extends, substantially in the vertical direction toward a side separated from the upper edge portion 30*a*, from the connection point "c" for connecting the second antenna element 2 to the power feeding electrode 6, as a starting point, to a lower end "d," which is an end point.

Further, in the antenna conductor γ, the line-shaped element 3 (the third antenna element) extends from a connection point "e" for connecting the third antenna element 3 to the power feeding electrode 6, as a starting point, to an end portion f in a direction to separate from the ground plate 7. The line-shaped element 4 (the fourth antenna element) is connected to the end portion f of the line-shaped element 3, and the line-shaped element 4 extends upward to an end portion g, i.e., extends, to the end portion g, in a direction to approach the upper edge portion 30*a*. The line-shaped element 5 (the fifth antenna element) is connected to the end portion (connecting portion) f of the line-shaped element 3 and the line-shaped element 4 (namely, the connecting portion for connecting the line-shaped element 3 and the line-shaped element 4), and the line-shaped element 5 extends downward to an end portion h, i.e., extends, to the end portion h, in a direction to separate from the upper edge portion 30*a*.

In this manner, in the embodiment, among a plurality of antenna elements forming the antenna conductors, the first antenna element 1 and the second antenna element 2 are installed in the window glass 11, so that the first antenna element 1 and the second antenna element 2 have vector components in the vertical direction with respect to the ground plane (especially, the horizontal plane). Thus, a vertically polarized radio wave of the communication wave can be more easily received. An angle for installing the window glass 11 to the vehicle may preferably be from 15 degrees to 90 degrees with respect to the ground plane, for example.

Figure 5:
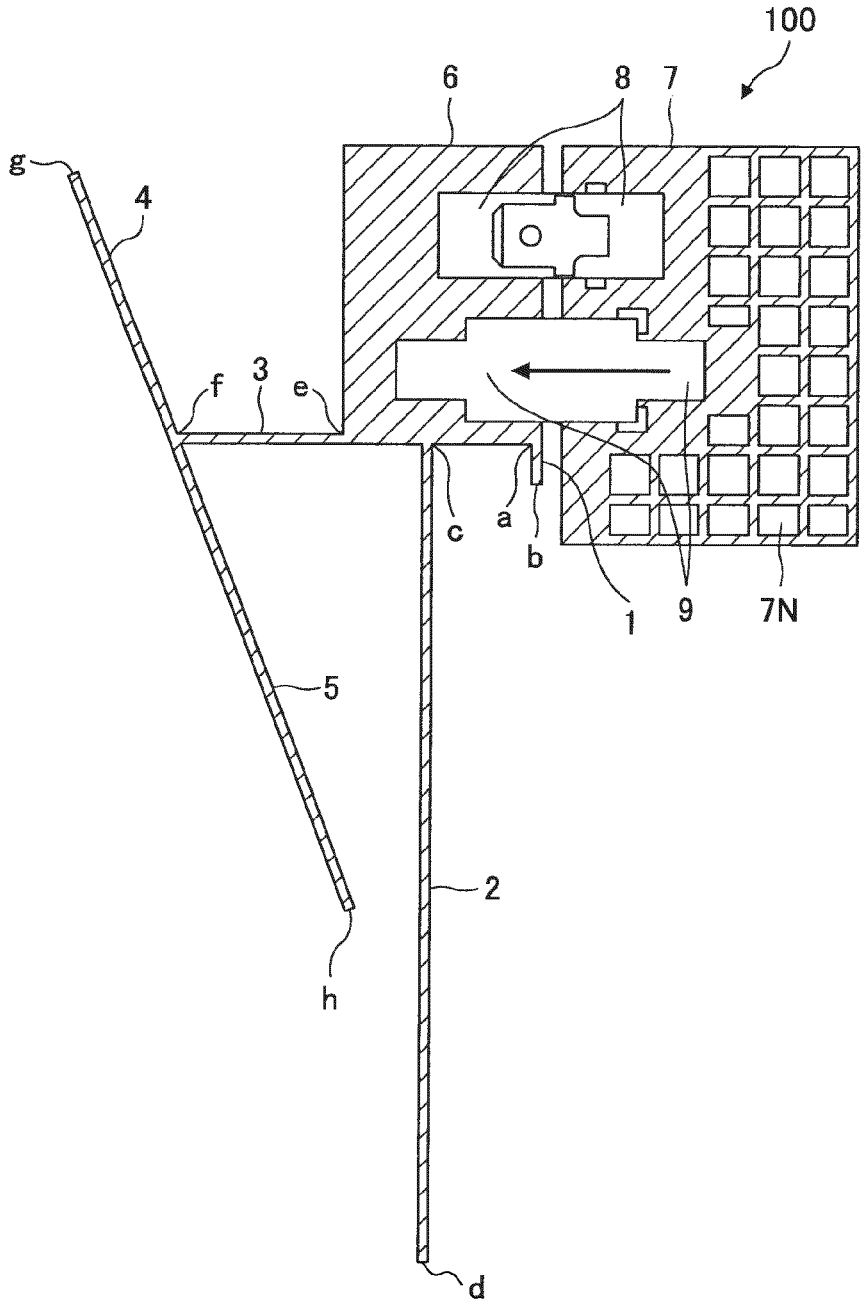
FIG. 5 is a diagram magnifying and illustrating the communication glass antenna illustrated in FIG. 4, to which a resistor and a connecter are attached.

FIG. 5 is a diagram magnifying and illustrating the glass antenna 100, which is illustrated in FIG. 4. In FIG. 5, a resistor 8 and a connector 9 are installed in the glass antenna 100.

The communication antenna according to the embodiment transmits and receives information including information for a telematics service. As the nature of the telematics service, real time communication and emergency communication may be required, so that it is necessary to maintain a connected state of the network. Thus, in the embodiment of the present invention, the resistor 8 to detect a connection is provided so as to detect, at least, that the antennas are connected.

Additionally, in the embodiment of the present invention, the connecter 9 is provided. In this configuration, a closed circuit is formed by a route connecting the power feeding electrode 6 that is connected to the antenna elements; the ground electrode 7; the connector 9; the resistor 8; an inner conductor of a coaxial cable; and an external conductor, such as braided wire. In such a configuration, in response to detecting, by a communication device (not depicted) installed in the vehicle and connected to the coaxial cable, that a resistance value in a predetermined range is not obtained for the circuit including the resistor 8, it is determined that the antennas are not connected, and that communication may not be executed.

Figure 6A:
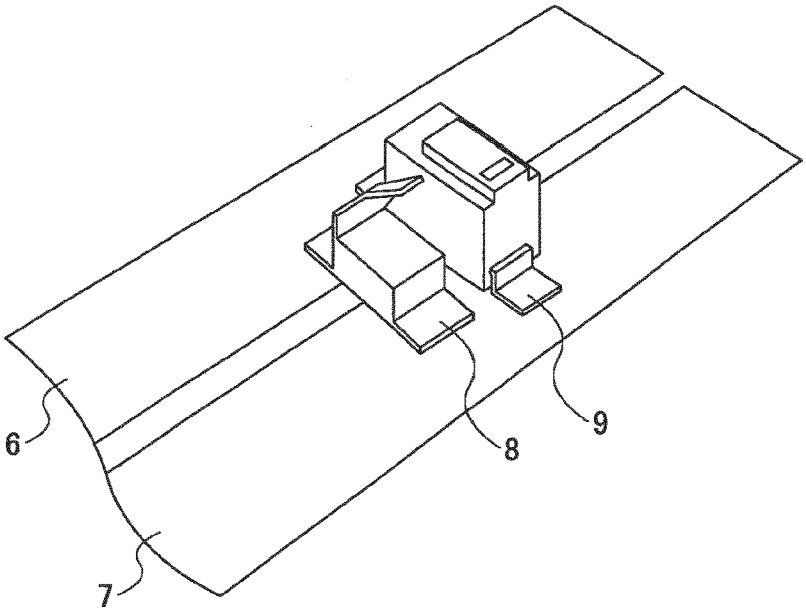
FIG. 6A is a perspective view illustrating a state in which the resistor and the connector of FIG. 4 are attached to the antenna.

FIG. 6A is a perspective view of a state where the resistor 8 and the connector 9 of FIG. 5 are installed. FIG. 6A illustrates an example where the resistor 8 (a resistance module element) and the connector 9 are installed on the pair of the electrodes 6 and 7 of the glass antenna 100 by separately soldering. Here, the electrodes 6 and 7 are formed by silver printing.

Figure 6B:
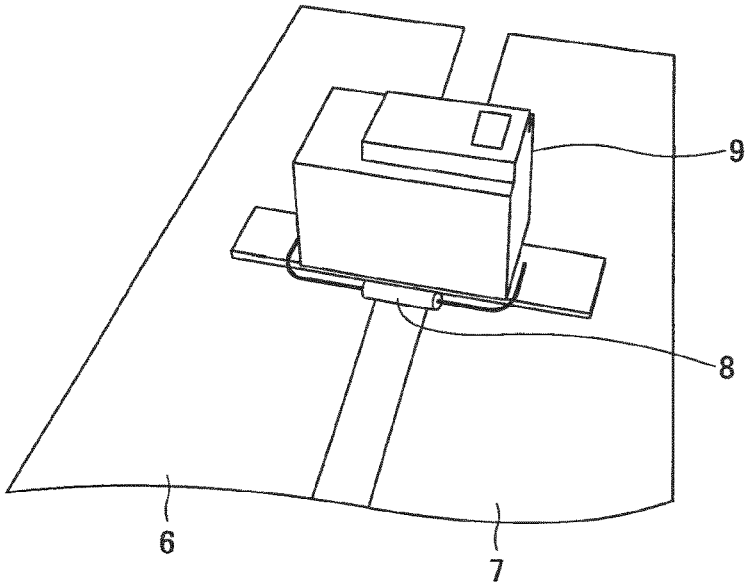
FIG. 6B is another perspective view illustrating the state in which the resistor and the connector are attached to the antenna.

FIG. 6B is a perspective view of another example where the resistor 8 and the connector 9 are installed on the antenna 100. FIG. 6B illustrates an example where leg portions of the resistor 8 (an axial lead resistor) and leg portions of the connector 9 are connected, in advance, by welding or soldering; and the leg portions are installed on the pair of the electrodes 6 and 7 by soldering. Here, the electrodes 6 and 7 are formed by silver printing.

The power feeding electrode 6 is a feeding point (feeder) at which an inner conductor of a coaxial cable is electrically connected. The coaxial cable is connected to a receiver.

In the window glass 11, the power feeding electrode 6 (a positive electrode feeder, or a feeder electrode) and an inner conductor of a coaxial cable are electrically connected; and the ground electrode 7 (a negative electrode feeder, or a ground electrode) and an external conductor of the coaxial cable are electrically connected. By a configuration in which the connector 9 (cf. FIG. 5) for electrically connecting the inner conductor of the coaxial cable to the power feeding electrode 6 and for electrically connecting the outer conductor of the coaxial cable to the ground electrode 7 is installed on the power feeding electrode 6 and the ground electrode 7, the inner conductor of the coaxial cable can be easily installed on the power feeding electrode 6, and the outer conductor of the coaxial cable can be easily installed on the ground electrode 7.

It suffices if the ground electrode 7 is disposed close to the power feeding electrode 6 in the vicinity of the power feeding electrode 6 such that the ground electrode 7 does not contact the power feeding electrode 6, and the ground electrode 7 does not contact the antenna conductors α to γ, which are electrically connected to the power feeding electrode 6. For the cases of FIG. 4 and FIGS. 13 to 16, the ground electrode 7 is disposed to the right side of the power feeding electrode 6 while the ground electrode 7 is separated from the power feeding electrode 6. The ground electrode 7 may be disposed above the power feeding electrode 6 while the ground electrode 7 is separated from the power feeding electrode 6 (e.g., the example of FIG. 17). Alternatively, for a case of installing the antenna 100 at a right side with respect to the center line 12 of the window glass 11, the ground electrode 7 may be disposed at a left side of the power feeding electrode 6, while the ground electrode 7 is separated from the power feeding electrode 6.

The shape of the power feeding electrode 6 may be determined depending on a tip shape of the feeder line directly attached to the power feeding electrode 6, or a shape of a connector for connecting the power feeding electrode 6 to the feeder line (e.g., a shape of the surface on which the connector 9 is installed, or a shape of a contact terminal). For example, for implementation, the shape of the power feeding electrode 6 may preferably be a rectangular shape, such as a square, an approximate square, a rectangle, or an approximate rectangle; or a polygonal shape. Alternatively, the shape of the power feeding electrode 6 may be a circular shape, such as a circle, an approximate circle, an oval, or an approximate oval.

The shape of the ground electrode 7 may be any shape, similar to the case of the power feeding electrode 6. The clearance between the power feeding electrode 6 and the ground electrode 7 may be determined depending on the tip shape of the feeder line directly attached to the power feeding electrode 6 and a tip shape of the feeder line directly attached to the ground electrode 7, or the shape of the connector for connecting the power feeding electrode 6 to the feeder line and a shape of a connector for connecting the ground electrode 7 to the feeder line (e.g., a shape of the surface on which the connector 9 is installed, or a shape of a contact terminal).

Here, for the communication waves, specified used frequencies differ depending on countries; and, for each country, used frequencies differ depending on operators. Thus, an antenna that supports a wide band is preferable, so that a plurality of communication waves can be received.

In ultra high frequency (UHF) waves used for communication, the glass antenna 100 according to the embodiment of the present invention is configured such that the glass antenna 100 allows communication in three frequency bands of the frequency band used for Long Term Evolution (LTE), which are from 0.698 GHz to 0.894 GHz; from 1.71 GHz to 1.995 GHz; and from 2.496 GHz to 2.69 GHz. The glass antenna 100 supports the plurality of frequencies by including the pair of electrodes 6 and 7; and the plurality of antenna elements 1 to 5.

In the following, for each frequency band, simulation of a corresponding current is described below by referring to FIGS. 7 to 12.

Figure 7:
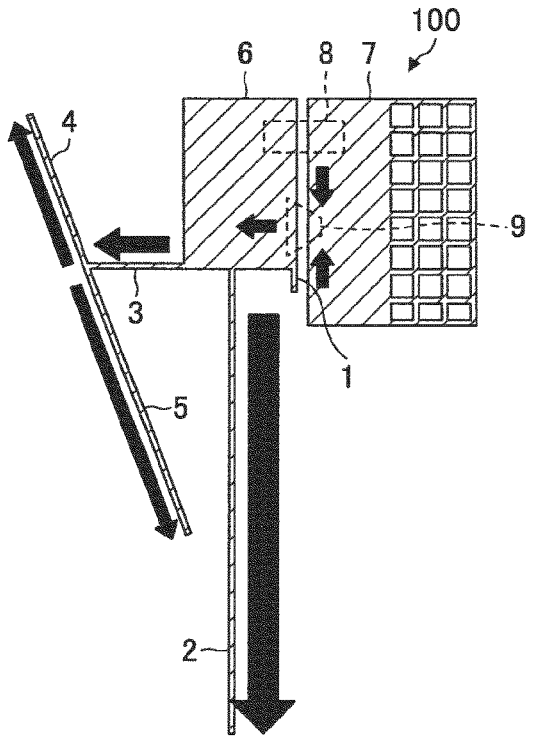
FIG. 7 is a schematic diagram illustrating magnitude of a current for a case where a frequency is 0.7 GHz.
Figure 8:
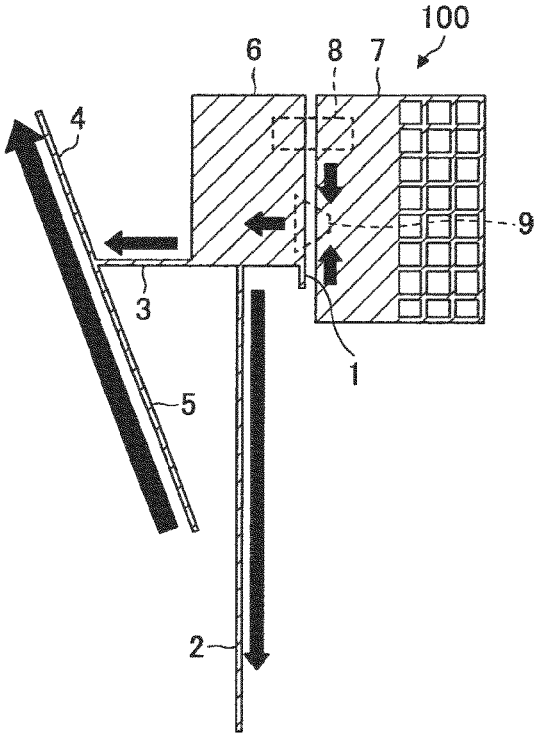
FIG. 8 is a schematic diagram illustrating the magnitude of the current for a case where a frequency is 0.8 GHz.
Figure 9:
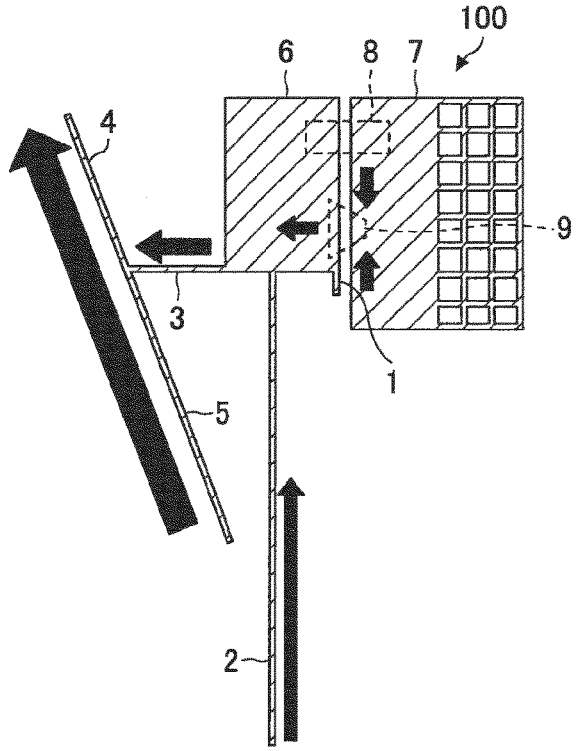
FIG. 9 is a schematic diagram illustrating the magnitude of the current for a case where a frequency is 0.9 GHz.

FIGS. 7 to 9 are diagrams illustrating the simulation corresponding to the frequency band from 0.698 GHz to 0.894 GHz (which may be referred to as "Band 1," hereinafter). FIG. 7 is a schematic diagram illustrating magnitude of an electric current for a case where the frequency is 0.7 GHz. When the frequency is 0.7 GHz, the electric current flows through the second antenna element 2, and thereby the second antenna element 2 emits electromagnetic waves.

FIG. 8 is a schematic diagram illustrating magnitude of an electric current for a case where the frequency is 0.8 GHz. When the frequency is 0.8 GHz, an electric current flows through the second element 2, and an electric current flows through the line-shaped element 4 and the line-shaped element 5; and the second element 2 emits electromagnetic waves, and the line-shaped element 4 and the line-shaped element 5 emit electromagnetic waves. Here, the electromagnetic waves are emitted by using capacitive coupling and electromagnetic field coupling caused by proximity between the second antenna element 2 and the line-shaped elements 4 and 5.

FIG. 9 is a schematic diagram illustrating magnitude of an electric current for a case where the frequency is 0.9 GHz. When the frequency is 0.9 GHz, an electric current flows through the line-shaped element 4 and the line-shaped element 5, and thereby the line-shaped element 4 and the line-shaped element 5 emit electromagnetic waves.

Figure 10:
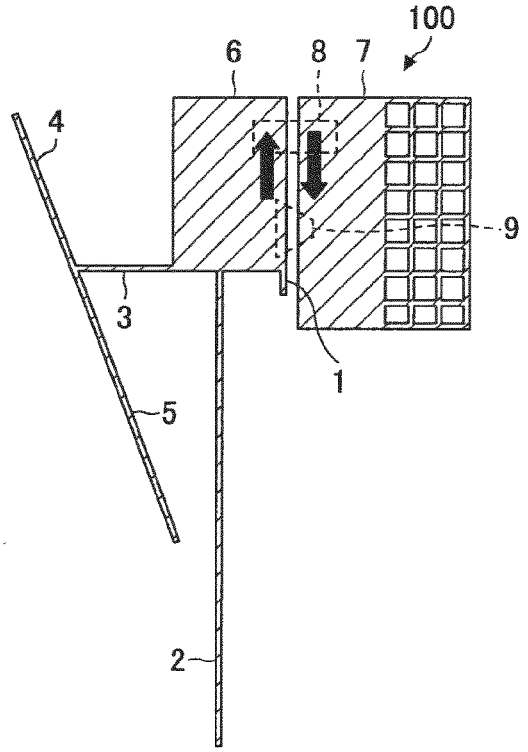
FIG. 10 is a schematic diagram illustrating the magnitude of the current for a case where a frequency is 1.71 and 2 GHz.

FIG. 10 is a diagram illustrating the simulation corresponding to the frequency band from 1.71 GHz to 1.995 GHz (which may be referred to as "Band 2," hereinafter). Magnitude of an electric current for a case where the frequency is 1.71 GHz is almost the same as magnitude of an electric current for a case where the frequency is 2 GHz. For 1.71 GHz and 2 GHz, which is the second frequency band (the Band 2), the frequency of the band is higher than the frequency of the band of the first frequency band (the Band 1), and a wavelength is short, so that an electric current flows due to coupling between the ground electrode 7 and the power feeding electrode 6.

Figure 11:
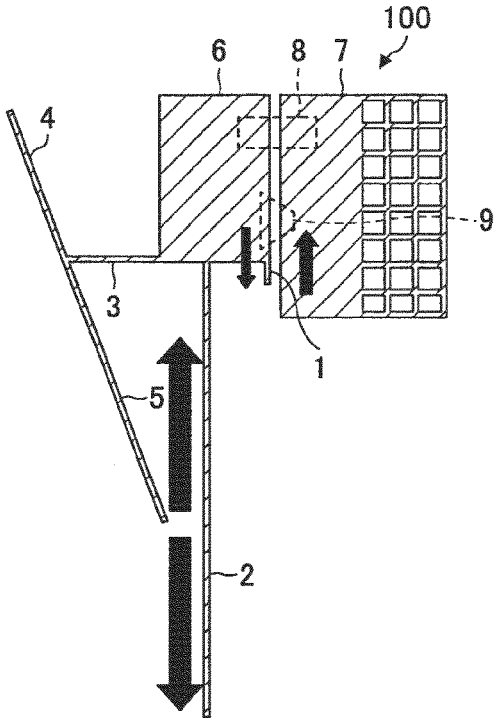
FIG. 11 is a schematic diagram illustrating the magnitude of the current for a case where a frequency is 2.5 GHz.
Figure 12:
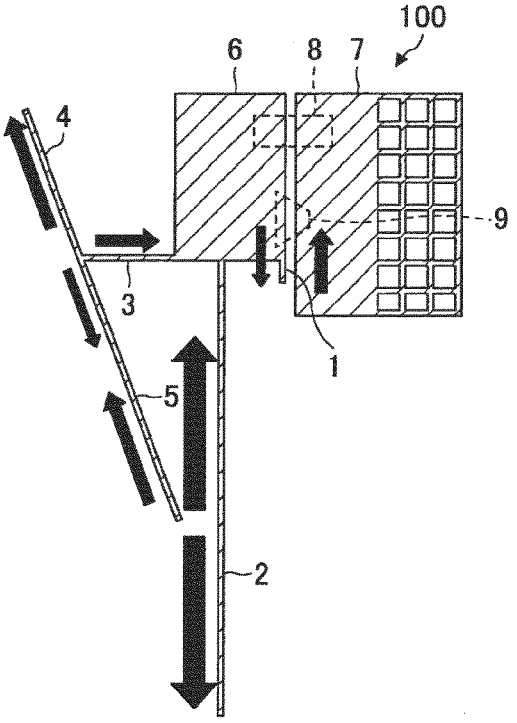
FIG. 12 is a schematic diagram illustrating the magnitude of the current for a case where a frequency is 2.69 GHz.

FIGS. 11 and 12 are diagrams illustrating the simulation corresponding to the frequency band from 2.496 GHz to 2.69 GHz (which may be referred to as "Band 3," hereinafter). FIG. 11 is a schematic diagram illustrating magnitude of an electric current for a case where the frequency is 2.5 GHz. The electric currents mainly flow through the coupling between the electrodes 6 and 7; the first antenna element 1, which is short; and the second antenna element 2.

FIG. 12 is a schematic diagram illustrating magnitude of an electric current for a case where the frequency is 2.69 GHz. The electric current mainly flow through the coupling between the electrodes 6 and 7; and all the antenna elements 1 to 5.

As can be seen from FIGS. 7 to 12, by combining the plurality of elements and using the plurality of elements as an antenna, communication is allowed for a broad frequency band.

It can be seen from the above-described simulation that the first frequency band, which is the lowest frequency band among the communication waves that can be received in the embodiment of the present invention, is received by the second antenna element 2, which is long; the line-shaped element 4; and the line-shaped element 5.

Specifically, in the vicinity of 0.7 GHz, the communication waves are mainly received by the second antenna element 2. Thus, assuming that the wavelength of the frequency of 0.7 GHz in the air is $\lambda_{01}$, that a wavelength shortening coefficient of the window glass 11 is $k_1$, and that the wavelength on the window glass 11 is $\lambda_{g1}=\lambda_{01}\cdot k_1$, if the longest path L2 from the power feeding electrode 6 to the tip of the second antenna element 2 (i.e., the conductor length of the antenna element 2) is greater than or equal to $(29/100)\cdot\lambda_{g1}$ and less than or equal to $(4/10)\cdot\lambda_{g1}$, while setting the $(3/10)\cdot\lambda_{g1}$ as a target value, the glass antenna 100 resonates at a frequency in the vicinity of 0.7 GHz, so that a favorable result can be obtained to enhance the antenna gain.

Consequently, if it is desired to enhance the antenna gain with respect to a frequency in the vicinity of 0.7 GHz, while assuming that the speed of radio waves is $3.0\times10^8$ m/s, and that the wavelength shortening coefficient $k_1$ is 0.61, the conductor length of the second antenna element 2, which has a path length L2, can be adjusted to be greater than or equal to 76 mm and less than or equal to 105 mm.

In the vicinity of 0.9 GHz, the straight line formed of the line-shaped element 4 and the line-shaped element 5 mainly receives the communication waves. Thus, assuming that the wavelength of the frequency of 0.9 GHz in the air is $\lambda_{02}$, that a wavelength shortening coefficient of the window glass 11 is $k_2$, and that the wavelength on the window glass 11 is $\lambda_{g2}=\lambda_{02}\cdot k_2$, if the path length Lb from the upper end g of the line-shaped element 4 to the lower end h of the line-shaped element 5 is greater than or equal to $(35/100)\cdot\lambda_{g2}$ and less than or equal to $(45/100)\cdot\lambda_{g2}$, while setting the $(4/10)\cdot\lambda_{g2}$ as a target value, the glass antenna 100 resonates at a frequency in the vicinity of 0.9 GHz, so that a favorable result can be obtained to enhance the antenna gain.

Consequently, if it is desired to enhance the antenna gain with respect to a frequency in the vicinity of 0.9 GHz, while assuming that the speed of radio waves is $3.0\times10^8$ m/s, and that the wavelength shortening coefficient $k_2$ is 0.58, a total value of a conductor length L4 of the line-shaped element 4 and a conductor length L5 of the line-shaped element 5, which is a conductor length L45, can be adjusted to be greater than or equal to 68 mm and less than or equal to 87 mm.

Note that, the conductor length L2 of the second antenna element 2 may preferably differ from the conductor length L45 of the straight line formed of the line-shaped element 4 and the line-shaped element 5 so as to ensure a wide-band characteristic. In the embodiment, it is assumed that the conductor length of the second antenna element 2 is greater than the conductor length L45 of the straight line formed of the line-shaped element 4 and the line-shaped element 5, and that the the second antenna element 2, which is the longer one, enables communication in the vicinity of 0.7 GHz at the low frequency side. However, the length L2 and the length L45 may be vice-versa. Namely, the conductor length L2 of the second antenna element 2 may be shorter than the conductor length L45 of the straight line, and in this case, the second antenna element 2, which is the shorter one, receives a frequency in the vicinity of 0.9 GHz, and the straight line, which is the longer one, receives a frequency in the vicinity of 0.7 GHz.

Here, in order to allow communication by using different wavelengths, the second antenna element 2 and the straight line formed of the fourth antenna element and the fifth antenna element are disposed to be separated by a predetermined distance, regardless of whether the conductor length of the second antenna element 2 is greater than the conductor length L45 of the straight line formed of the fourth antenna element and the fifth antenna element. For the case of FIG. 4, the lower end h of the line-shaped element 5 is the closest to the second antenna element 2; however the distance between the lower end h of the line-shaped element 5 and the second antenna element 2 may preferably be greater than or equal to 3 mm.

In the vicinity of 2.5 GHz and 2.69 GHz, the first antenna element 1 mainly affects the impedance characteristic of the antenna. In this case, the wavelength shortening coefficient $k_3$ becomes 0.5, and $\lambda_{g3}$ becomes 60 mm, and the electrodes 6 and 7 are involved in the communication. The conductor length L1 of the antenna element 1 is adjusted mainly for matching adjustment of the power supply. The first antenna element 1 is installed in parallel with a part of the ground electrode 7 in the vicinity of the ground electrode 7, so that the first antenna element 1 is coupled to the ground electrode 7, which determines matching (return loss) in the vicinity of 2.5 GHz and 2.69 GHz. Thus, the conductor length L1 of the first antenna element 1 may preferably adjusted to be greater than or equal to 2 mm and less than or equal to 6 mm.

Further, in the glass antenna 100 according to the embodiment of the present invention, each of the electrodes 6 and 7 includes a planar portion (filled portion) having a large width. Thus, the glass antenna 100 can support a wide frequency band.

However, if the area of the planar portion is too large, the strength of the part of the glass corresponding to the planer portion, as the glass for the vehicle, may become insufficient, or deformation may occur due to differences in heat absorption and stress between the glass and the metal. Thus, In the ground electrode 7, punched parts 7N are formed at a position where the resistor 8 and the connector 9 are not installed (cf. FIGS. 4 and 5), so that the width of the ground electrode 7 can be enlarged while maintaining the strength of the glass. Here, punched parts may be formed not only in the ground electrode 7, but also in the power feeding electrode 6 at a position where the connector 9 is not installed.

As described above, the glass antenna 100 according to the embodiment of the present invention includes the plurality of antenna elements with different lengths. As can be seen from the simulation of FIGS. 7 to 12, the glass antenna 100 according to the embodiment of the present invention may support a wide frequency band including a plurality of frequency bands, without affecting the design or an aerodynamic characteristic of the vehicle.

The vehicle is a mobile body. Thus, the vehicle may preferably include a plurality of antennas; and a radio wave selector for selecting one of the plurality of antennas having favorable reception sensitivity, depending on a location. Alternatively or additionally, a multiple-input multiple-output (MIMO) configuration, which is a function to increase communication capacity, may more preferably be formed of the plurality of antennas.

Thus, in the embodiment of the present invention, another antenna for a wide frequency band, which is configured to be the same as the antenna 100 according to the embodiment of the present invention, may be provided on the window glass 11 at a position that is substantially line symmetrical to the position where the antenna 100 is installed with respect to the centerline 12 in the width direction of the window glass 11. In this case, in order to avoid mutual interference between the antennas, the antennas may preferably be installed to be separated by a predetermined distance (e.g., greater than or equal to 86 mm, which is 0.2 wavelength of 0.7 GHz). In this manner, communication performance can be enhanced by installing a plurality of glass antennas on the window glass 11, and by switching the antennas. Alternatively, by the MIMO configuration, even for the vehicle, which is a mobile body, a wide frequency band can be supported, and the communication capacity can be enhanced.

Figure 13:
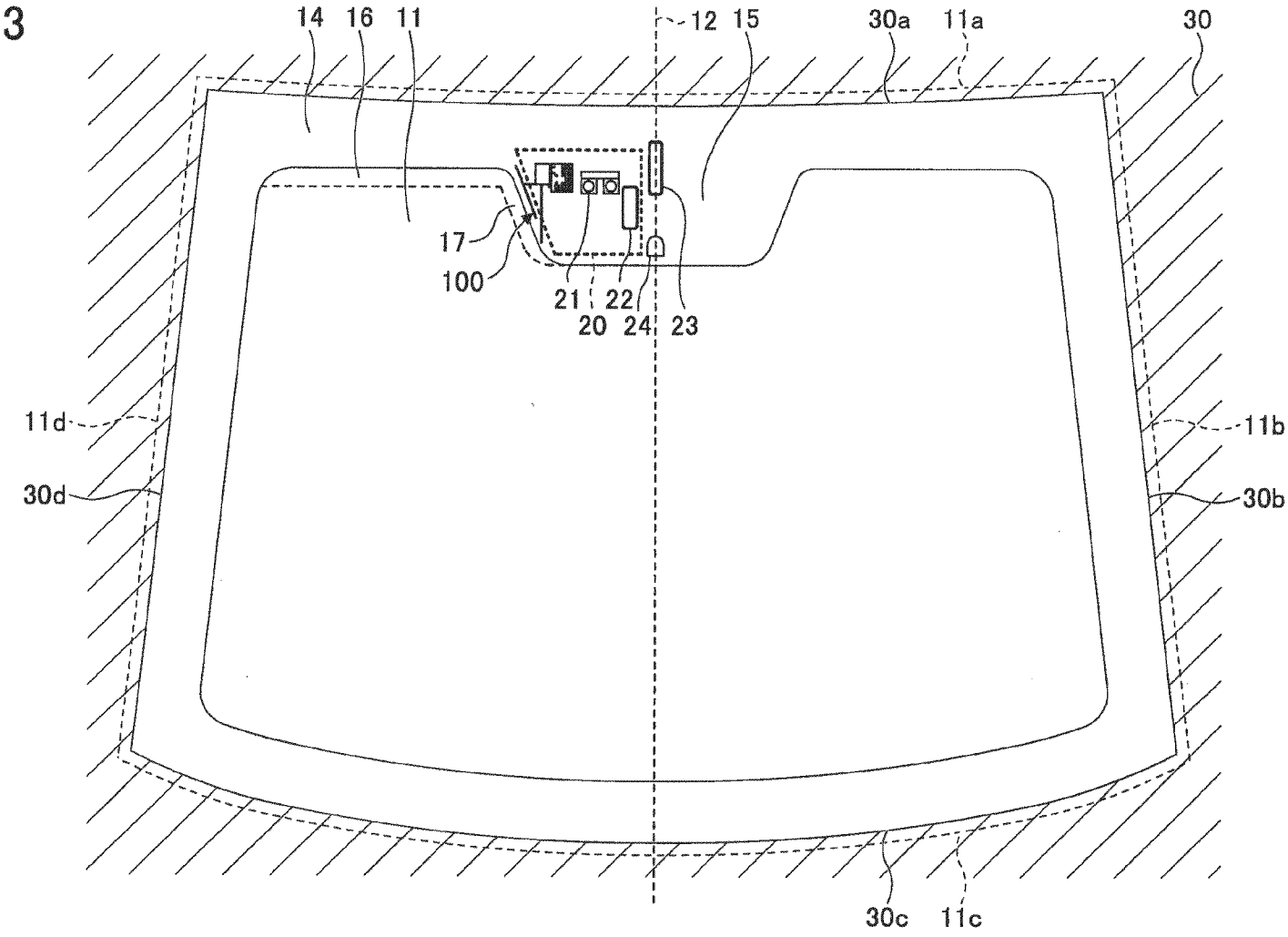
FIG. 13 is a diagram illustrating the whole window shield in which the glass antenna illustrated in FIG. 4, a camera, and a rain sensor are installed while covered with a cover.

FIG. 13 is a schematic diagram illustrating the entire front window glass 11 for a vehicle. In FIG. 13, the glass antenna 100, a camera 21, and a rain sensor 22 according to the embodiment of the present invention are covered with a cover 20, and installed on the front window glass 11 for the vehicle.

In these days, in order to enhance safety of the vehicle, a stereo camera with two lenses for measuring a distance is often installed on a front window. In the installed camera, a shift between two images (a standard image and a reference image), which are obtained by capturing the same object by using a plurality of cameras, is calculated, and a distance to the object (e.g., a person, a vehicle, or a traffic signal) is measured based on the shift of the images. Thus, in order to allow an object in front of the vehicle to be evenly detected in the horizontal direction (the left/right direction), the stereo camera tends to be installed on the windshield at an upper portion in the vicinity of a substantially central position in the horizontal direction.

Furthermore, the rain sensor 22 for detecting a state of the rain hitting on the glass also tends to be installed on the windshield, so that a wiper can be automatically controlled to release a driver from operating a wiper switch, while enhancing visibility in rainy weather.

For a case of installing such a camera 21 and/or a rain sensor 22, the camera 21 and/or the rain sensor 22 may be covered with a cover so as to avoid malfunctioning, while enhancing the appearance. The glass antenna 100 according to the embodiment of the present invention may preferably be installed on the window glass 11, so that the glass antenna 100 is hidden by the cover 20, i.e., the glass antenna 100 is accommodated inside the cover 20.

However, the cover 20 may not cover all the glass antenna 100. The cover 20 may installed to cover the resistor 8 and the connector 9, which are installed to protrude from the window glass 11 toward the space; and at least a part of the ground electrode 7 and the power feeding electrode 6, which form the planar portions. Here, the resistor 8, the connector 9, the ground electrode 7, and the power feeding electrode 6 significantly affect the appearance. The antenna elements 1 to 5 are embedded inside the window glass 11, and the antenna elements 1 to 5 have thin line shapes. Thus, even if the antenna elements 1 to 5 are installed outside the cover 20, the antenna elements 1 to 5 are not noticeable.

Here, as illustrated in FIG. 13, the cover 20 corresponding to the glass antenna 100 according to the embodiment, which is illustrated in FIG. 4, is formed to have a trapezoidal shape such that the upper edge is long and the lower edge is short. The protruding portion 15, which includes the shielding dot portion 17, of the part of the shielding film 14, on which the trapezoidal cover 20 is installed, is also formed to have a trapezoidal shape such that the upper edge is long and the lower edge is short. A side edge of the shielding dot portion 17, which is in the vicinity of the side edge of the protruding portion 15, is a straight line.

In this configuration, as illustrated in FIG. 13, the line-shaped element 4 and the line-shaped element 5 form the straight line. The line-shaped element 4 and the line-shaped element 5 may preferably be parallel along the side edge of the protruding portion 15 of the shielding film 14 and the side edge of the cover 20.

As an example of "along the side edge," the line shaped element 4 and the line-shaped element 5 may preferably be within 15 mm toward inside and within 15 mm toward outside, more preferably within 10 mm, from one edge (the side edge) of the protruding portion 15.

In this case, the straight line formed of the line-shaped element 4 and the line-shaped element 5 is disposed, so that the distance between an upper virtual extension line of the second antenna element 2 and the upper end g of the straight line is greater than the distance between the second antenna element 2 and the lower end h of the straight line. Namely, in the straight line, the lower end h of the straight line is the closest point to the second antenna element 2. The straight line and the second antenna element 2 are not parallel, and the straight line is extended such that, as a point on the straight line moves upward, the distance between the point and the second antenna element 2 becomes greater.

By forming the glass antenna 100 in this manner, the glass antenna 100 protrudes toward the central area of the window glass 11 from the upper edge portion 30*a*, and, at a lower side separated from the upper edge portion 30*a*, the glass antenna 100 less occupies the space, thereby enhancing the appearance.

Note that an LTE antenna system has higher noise robustness, compared to an antenna system for receiving broadcast waves, such as radio broadcast waves and television broadcast waves. As illustrated in FIGS. 13 to 17, even if the LTE antenna system is disposed in the vicinity of the camera 21 and the rain sensor 22, communication waves to be transmitted and received are less interfered with by the noise.

Note that, in FIGS. 13 to 17, the reference numeral 23 indicates a rearview mirror wiring support portion, and the reference numeral 24 indicates a mirror base, which is a rearview mirror support portion. The rearview mirror wiring support portion 23 and the mirror base 24 are disposed outside the cover 20.

<Another Embodiment>

Figure 14:
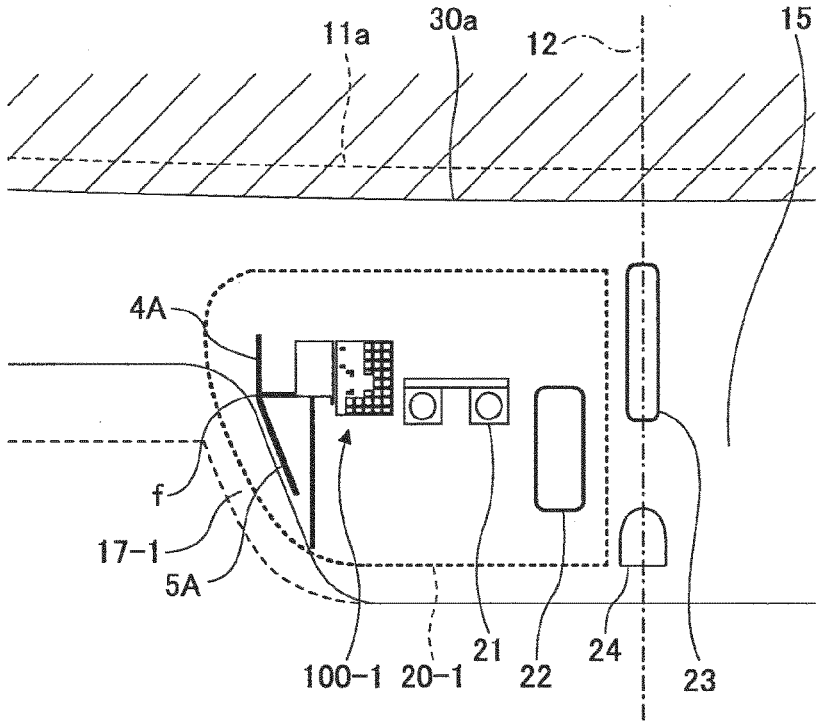
FIG. 14 is a plane view illustrating a part of the window shield in which the glass antenna according to another embodiment, the camera, and the rain sensor are installed while covered with the cover.

The shape of the glass antenna 100 according to an embodiment of the present invention may be modified in accordance with the shape of the cover and the protruding portion. FIG. 14 is a schematic diagram of a part of the front window glass 11 for a vehicle according to this embodiment. Here, a glass antenna 100-1, the camera 21, and the rain sensor 22 are installed in the front window glass 11, while the glass antenna 100-1, the camera 21, and the rain sensor 22 are covered with a cover 20-1.

In this embodiment, a side surface (a left side surface) of the cover 20-1 is curved toward the expanding direction (which is a curved line). Alternatively, the side surface of the cover 20-1 may be bent with a predetermined angle toward the expanding direction.

Thus, in the glass antenna 100-1 according to this embodiment, the line-shaped element 4A and the line-shaped element 5A do not form a straight line, and the connecting portion f is formed to bent outward. Even if the glass antenna 100-1 is formed in this manner, an effect that is the same as the above-described effect can be obtained.

The shape of the side edge of the protruding portion 15, which protrudes toward the central area of the window glass 11, of the shielding film 14 formed in the peripheral area of the window glass 11 and the shape along the side edge of the shielding dot portion 17-1 are not limited to the trapezoidal shape, and the side edge may be curved to expand, as illustrated in FIG. 14.

<Another Embodiment>

Figure 15:
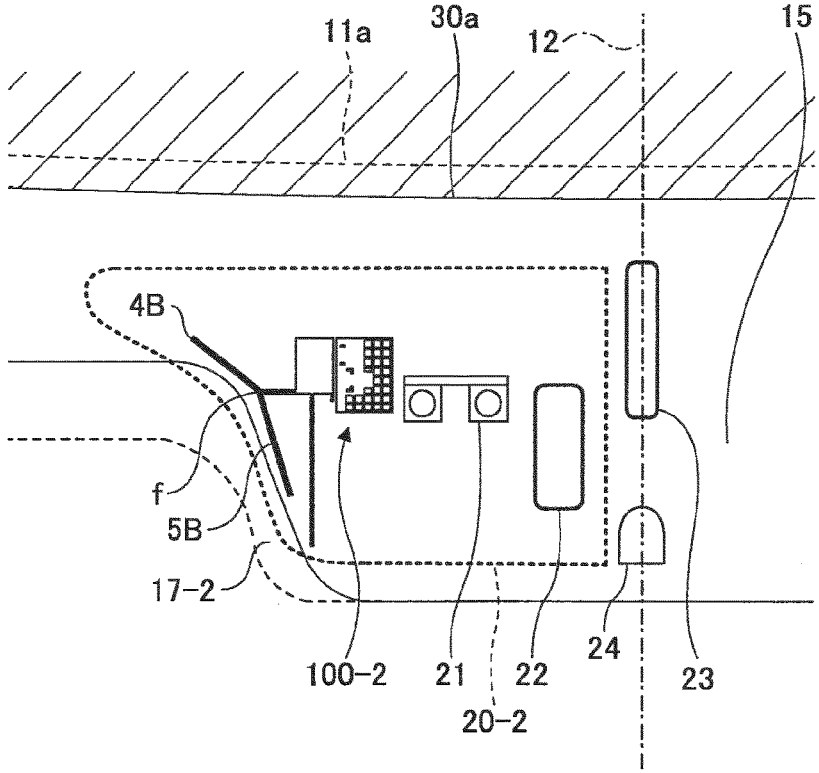
FIG. 15 is a plane view illustrating a part of the window shield in which the glass antenna according to another embodiment, the camera, and the rain sensor are installed while covered with the cover.

The shape of the glass antenna 100 according to an embodiment of the present invention may be modified in accordance with the shape of the cover and the protruding portion. FIG. 15 is a schematic diagram of a part of the front window glass 11 for a vehicle according to this embodiment. Here, a glass antenna 100-2, the camera 21, and the rain sensor 22 are installed in the front window glass 11, while the glass antenna 100-2, the camera 21, and the rain sensor 22 are covered with a cover 20-2.

In this embodiment, a side surface (a left side surface) of the cover 20-2 is curved toward the recessing direction. Alternatively, the side surface of the cover 20-2 may be bent with a predetermined angle toward the recessing direction.

Thus, in the glass antenna 100-2 according to this embodiment, the line-shaped element 4B and the line-shaped element 5B do not form a straight line, and the connecting portion f is formed to bent inward. Even if the glass antenna 100-2 is formed in this manner, an effect that is the same as the above-described effect can be obtained.

The shape of the side edge of the protruding portion 15, which protrudes toward the central area of the window glass 11, of the shielding film 14 formed in the peripheral area of the window glass 11 and the shape along the side edge of the shielding dot portion 17-2 are not limited to the trapezoidal shape, and the side edge may be curved to recess.

<Another Embodiment>

Figure 16:
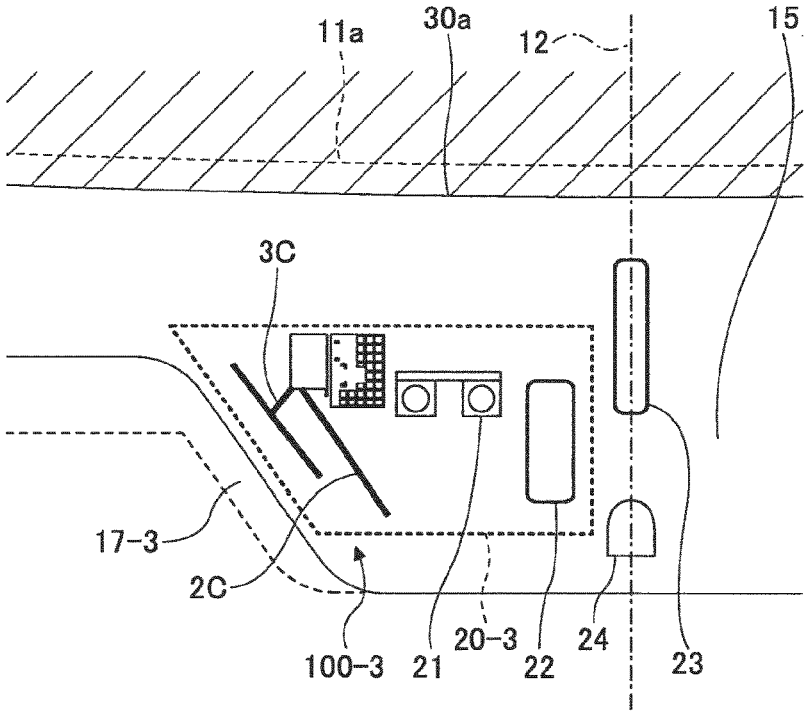
FIG. 16 is a plane view illustrating a part of the window shield in which the glass antenna according to another embodiment, the camera, and the rain sensor are installed while covered with the cover.

The shape of the glass antenna 100 according to an embodiment of the present invention may be modified in accordance with the shape of the cover and the protruding portion. FIG. 16 is a schematic diagram of a part of the front window glass 11 for a vehicle according to this embodiment. Here, a glass antenna 100-3, the camera 21, and the rain sensor 22 are installed in the front window glass 11, while the glass antenna 100-3, the camera 21, and the rain sensor 22 are covered with a cover 20-3.

In this embodiment, compared to the configuration of FIG. 13, the length (height) in the vertical direction of the protruding portion 15 is small, and the gradient of the side edge of the protruding portion 15 and the shielding dot portion 17-3, which is adjacent to the side edge, is small (close to the horizontal direction). Compared to the above-described embodiments, the length (height) of the cover 20-3, which is installed in the protruding portion 15, in the vertical direction is small.

For a case where the cover 20-3 is configured in this manner, the second antenna element 2C may not extend in the vertical direction, as long as the second antenna element 2C extends in a direction to separated from the upper edge portion 30*a* of the vehicle body 30, which is formed of the metal. The antenna element 2C may extend in a tilted direction, as long as the tilted direction is substantially a downward direction.

Additionally, the extending direction of the line-shaped element 3C is not limited to the horizontal direction, and the line-shaped element 3C may extend in any direction, as long as the direction differs from the extending direction of the second antenna element 2C.

Even if the glass antenna 100-3 is formed in this manner, an effect that is the same as the above-described effect can be obtained.

<Further Embodiment>

The shape of the glass antenna 100 according to an embodiment of the present invention may be modified in accordance with the shape of the cover and the protruding portion. FIG. 17 is a schematic diagram of a part of the front window glass 11 for a vehicle according to this embodiment. Here, a glass antenna 100-4, the camera 21, and the rain sensor 22 are installed in the front window glass 11, while the glass antenna 100-4, the camera 21, and the rain sensor 22 are covered with a cover 20-4.

In this embodiment, compared to the configuration of FIG. 13, the length (height) in the vertical direction of the protruding portion 15 is large, and the gradient of the side edge of the protruding portion 15 and the shielding dot portion 17-4, which is adjacent to the side edge, is large (close to the vertical direction). Compared to the above-described embodiments, the length (height) of the cover 20-4, which is installed in the protruding portion 15, in the vertical direction is large.

In this case, the direction for disposing the pair of electrodes 6D and 7D is not limited to the horizontal direction (the left/right direction), and the pair of electrodes 6D and 7D may be disposed in parallel in the vertical direction. In this case, the first antenna element 1D extends from the power feeding electrode 6D in the horizontal direction, so that the first antenna element 1D is parallel to one edge of the ground electrode 7D in the vicinity of the ground electrode 7D. In this configuration, the second antenna element 2D may not extend in the vertical direction, as long as the second antenna element 2D extends in the direction to separate from the upper edge portion 30*a* of the vehicle body 30. The second antenna element 2D may extend in a tilted direction, as long as the tilted direction is substantially a downward direction.

Additionally, the extending direction of the third antenna element 3D is not limited to the horizontal direction. The third antenna element 3D may extend in any direction, as long as the direction differs from the extending direction of the second antenna element 2D. In this case, in the straight line formed of the fourth antenna element 4D and the fifth antenna element 5D, the lower end h of the straight line is the closest point to the second antenna element 2. The straight line and the second antenna element 2 are not parallel, and the straight line is extended such that, as a point on the straight line moves upward, the distance between the point and the second antenna element 2 becomes greater. Note that the shape of the fourth antenna element 4D and the fifth antenna element 5D is not limited to the linear shape. As illustrated in the embodiment of FIG. 14, the fourth antenna element 4D and the fifth antenna element 5D may be formed, so that the connecting portion f is bent outward. Even if the glass antenna 100-4 is formed in this manner, an effect that is the same as the above-described effect can be obtained.

In the above-described embodiment, the configuration is described where the glass antenna 100 is installed at the left side while assuming an example that the glass antenna 100 is installed at the side of the front passenger seat in a right-hand drive vehicle. However, a glass antenna that is symmetrical to the above-described glass antenna 100 in the horizontal direction may be installed at the right side, which is the side of the front passenger seat, in the left-hand drive vehicle, or the antenna may be installed at the side of the driver's seat.

The glass antenna and the window glass are described above by the embodiments. However, the present invention is not limited to the above-described embodiments. Various modifications and improvements, such as a combination of one of the embodiments and a part or all of another embodiment, or substitution, may be made within the scope of the present invention.

EXAMPLES

For a vehicle glass antenna, which was produced by installing the glass antenna according to the above-described embodiment to actual vehicle window glass (windshield), an actual measurement result of the antenna gain is described.

Figure 18:
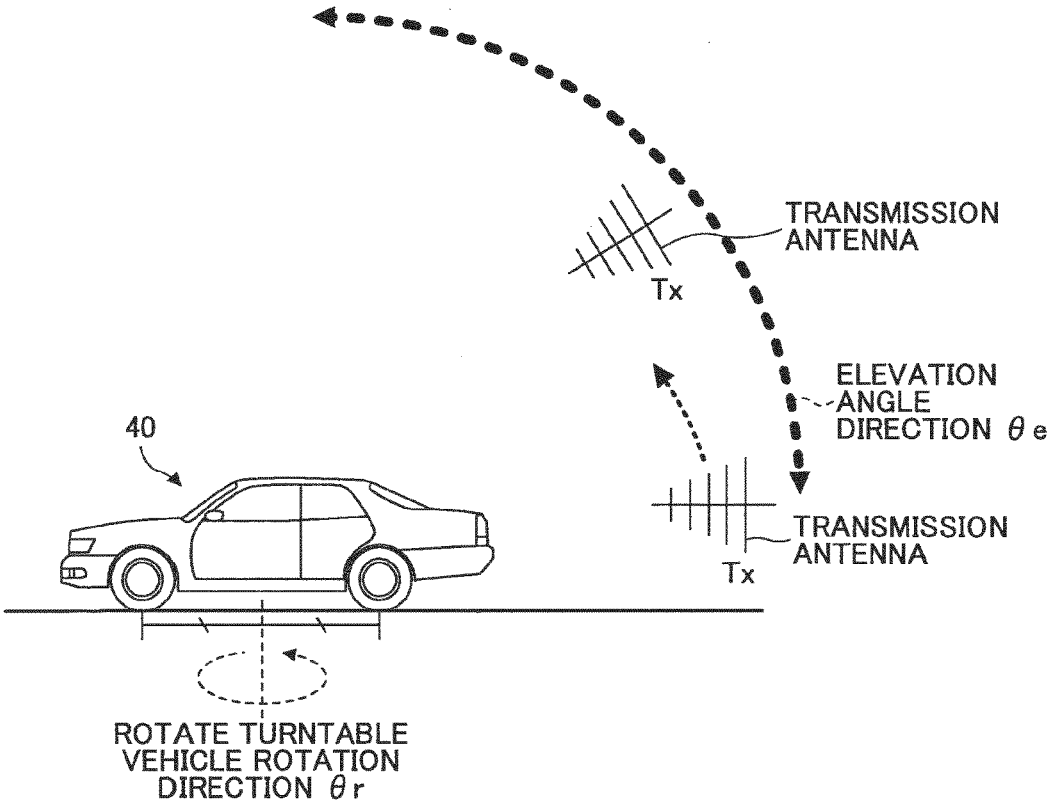
FIG. 18 is a diagram illustrating a state of the vehicle used for measurement and a transmitting antenna.

FIG. 18 is a schematic diagram illustrating the conditions of the experiment. FIG. 18 illustrates the vehicle 40, which was used for the measurement, and a state of a transmission antenna Tx. The antenna gain was actually measured after the vehicle window glass, in which the glass antenna was formed, was assembled to the window frame of the vehicle, which was on the turntable. At that time, the window glass was tilted approximately 27 degrees with respect to the horizontal plane.

The measurement was performed while the center of the axes in left, right, front, and rear of the vehicle 40 was aligned to the center of the turntable, and the vehicle 40 was rotated in the horizontal direction θr by 360 degrees. Here, the window glass, in which the glass antenna was formed, was installed in the vehicle 40.

The antenna gain was measured for every rotation angle of 2 degrees and for every 10 MHz in the frequency range of the communication waves. Additionally, assuming that an elevation angle of the plane parallel to the ground is 0 degrees, and that an elevation angle of the direction of zenith is 90 degrees, the antenna gain was measured in the elevation angle direction by varying the elevation angle θe of the transmission antenna Tx from 0 degrees to 30 degrees by 2 degrees each time. To measure the antenna gain, the measurement system was calibrated in advance by using a standard gain antenna, and the antenna gain was expressed in absolute gain.

Figure 19:
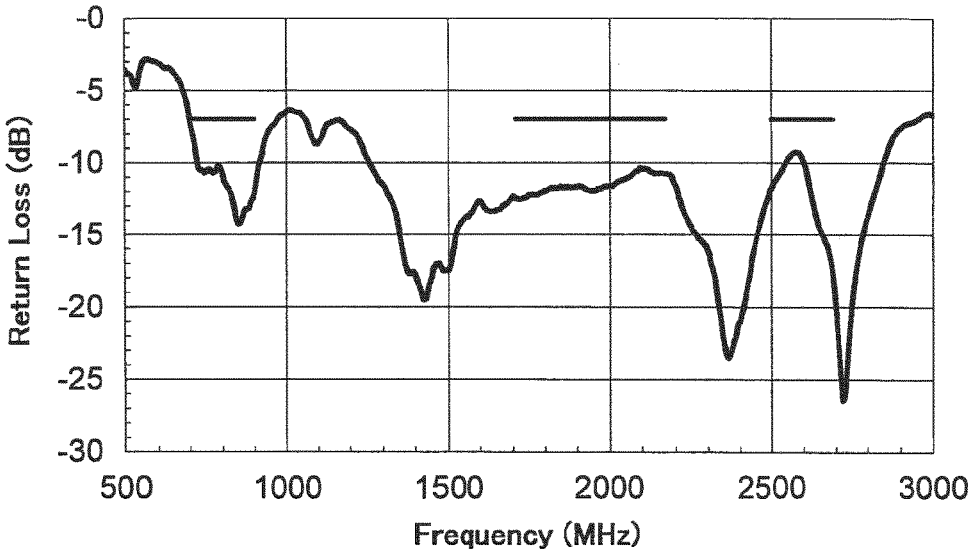
FIG. 19 is a graph illustrating return loss of the glass antenna.

FIG. 19 illustrates the return loss of the glass antenna 100, which is illustrated in FIGS. 3 and 4, in a frequency band used for communication.

Figure 20:
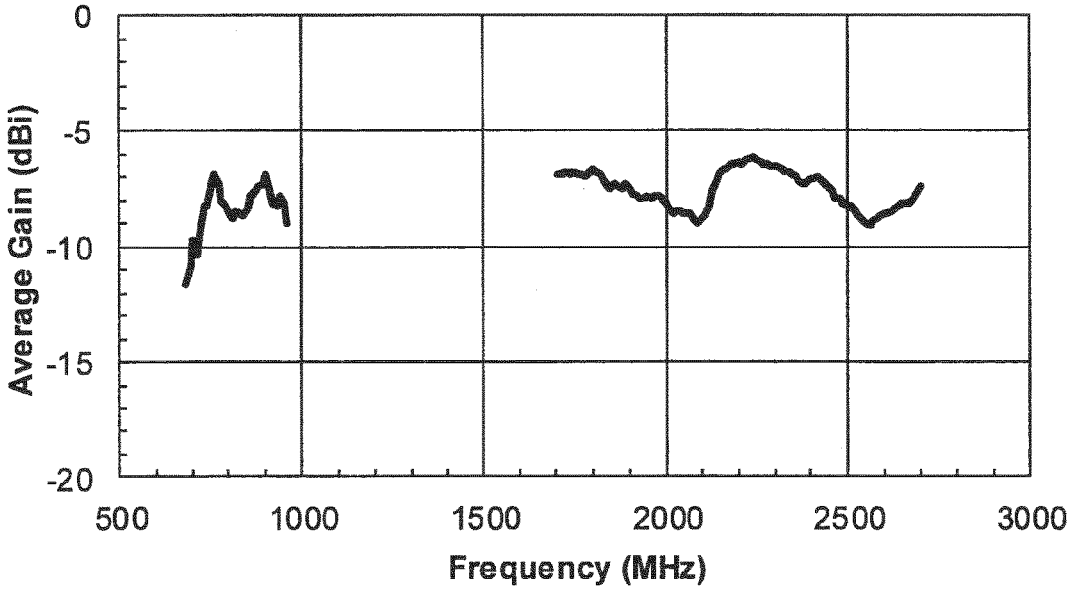
FIG. 20 is a graph illustrating a gain characteristic of the glass antenna with respect to a vertically polarized wave.
Figure 21:
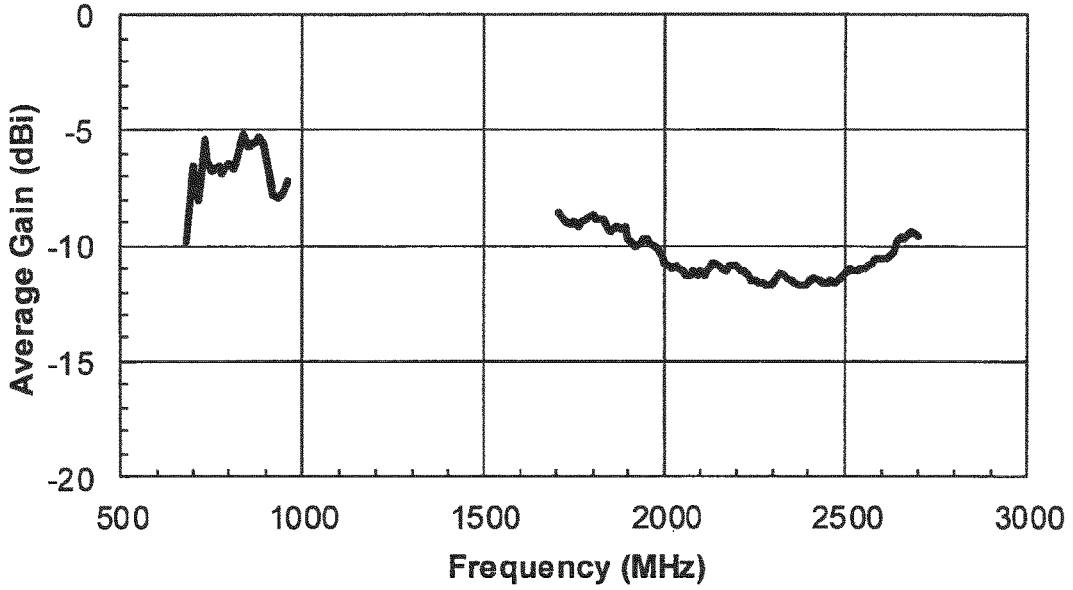
FIG. 21 is a graph illustrating a gain characteristic of the glass antenna with respect to a horizontally polarized wave.

FIG. 20 illustrates the gain (a result of averaging the gain over the whole circumference and the elevation angle) for receiving, by the glass antenna 100, vertically polarized waves from the transmission antenna Tx. FIG. 21 illustrates the gain for receiving, by the glass antenna 100, horizontally polarized waves from the transmission antenna Tx. Specifically, FIGS. 20 and 21 illustrate the average gain characteristics of the measured data, which was obtained by varying the elevation angle θe of the transmission antenna Tx from 0 degrees to 30 degrees by 2 degrees each time, and rotating, at each elevation angle θe, the vehicle 40 by 360 degrees (θr=0 to 360 degrees (whole circumference, 2 degrees each time).

The glass antenna 100 according to the embodiments of the present invention, which is illustrated in FIG. 4 (FIG. 5), was used for the measurement of FIGS. 19 to 21. In the shape of the glass antenna 100, which was used for the measurement of FIGS. 19 to 21, the sizes of the components in unit of mm were as follows:

L1: 4.0
L2: 82.0
L3: 16.8
L4: 28.1
L5: 49.8
L6: 30.0
L7: 20.0
L8: 30.0
L9: 40.0
D12: 11.0
D67: 2.0

Here, the line width of the antenna element was 1 mm; the size of each of the punched parts 7N was 4×4 mm; and θ (the angle between the L3 and L5) was 69 degrees.

As the position where the glass antenna 100 was disposed, the distance between the upper edge of each of the power feeding electrode 6 and the ground electrode 7 and the upper edge 30*a* of the vehicle body 30 was 27 mm.

In the embodiment, as an example, a resistor (a resistor module element) having a resistance value of +10 kΩ, and a tolerance of ±10% was used as the resistor 8. Additionally, an on-glass connector for a coaxial cable CE2 (produced by Japan Aviation Electronics Industry, Ltd.) was used as the connector 9. The on-glass connector CE 2 can be directly connected to a glass surface. However, the resistance value of the resistor 8 can be properly adjusted depending on the specification of the system; and the connector 9 is not limited to the above-described example, as long as the on-glass connector has the similar function.

In the frequency bands normally used for communication, the return loss may preferably be less than or equal to −7 dB; and more preferably less than or equal to −10 dB. As can be seen from the graph of FIG. 19, in the above-described Band 1, Band 2, and Band 3, which are frequency bands used for communication, the glass antenna 100 according to the embodiment of the present invention exhibits favorable return loss of less than or equal to −7 dB.

Table 1 shows, for FIG. 20, the average gain values (Average Gain) of the vertically polarized waves received by the glass antenna 100 in the three frequency bands, which are 0.698 GHz to 0.894 GHz (Band 1), 1.71 GHz to 1.995 GHz (Band 2), and 2.496 GHz to 2.69 GHz (Band 3), in the frequency band of the communication waves (e.g., the frequency band for Long Term Evolution (LTE)); and the average value of the gain values over the three frequency bands (3 Band Average). Table 2 shows, for FIG. 21, the average gain value of the horizontally polarized waves received by the glass antenna 100 for the communication waves in the above-described three frequency bands, and the average values over the three frequency bands.

TABLE 1

| | Band 1 | Band 2 | Band 3 | 3 Band Average |
|---|---|---|---|---|
| Average Gain (dBi) | −8.1 | −7.5 | −8.4 | −8.0 |

TABLE 2

| | Band 1 | Band 2 | Band 3 | 3 Band Average |
|---|---|---|---|---|
| Average Gain (dBi) | −6.2 | −9.9 | −10.4 | −8.8 |

As can be seen from FIG. 20, FIG. 21, Table 1, and Table 2, for the glass antenna 100 according to the embodiment of the present invention, the average gain value over the entire frequency bands of Band 1, Band 2, and Band 3, namely, the average value over the three frequency bands is greater than or equal to −9 dBi. Thus, favorable average gain for receiving the vertically polarized waves and the horizontally polarized waves can be obtained for the glass antenna 100 according to the embodiment of the present invention.

Note that, usually, communication waves have higher noise robustness, and the frequency used for the communication waves is higher than the frequency of the broadcast waves. Thus, even if the glass antenna 100 according to the embodiment of the present invention is disposed in the vicinity of the camera 21, the rain sensor 22, and an antenna for receiving broadcast waves, such as radio broadcast waves and television broadcast waves, the communication is not significantly affected.

What is claimed is:

1. A window glass for a vehicle, the window glass including a glass antenna for transmitting and receiving communication waves, the glass antenna comprising:

a pair of electrodes that are a ground electrode and a power feeding electrode;

a first antenna element that is connected to the power feeding electrode;

a second antenna element that is directly connected to the power feeding electrode, and that extends approximately downward, wherein the second antenna element is longer than the first antenna element;

a third antenna element that is connected to the power feeding electrode, and that extends in a direction other than the direction in which the second antenna element extends, wherein the third antenna element is shorter than the second antenna element;

a fourth antenna element, wherein one end of the fourth antenna element is connected to an end portion of the third antenna element, and the other end of the fourth antenna element extends upward; and a fifth antenna element, wherein one end of the fifth antenna element is connected to the end portion of the third antenna element and the one end of the fourth antenna element, and the other end of the fifth antenna element extends downward, wherein the electrodes of the pair of electrodes are disposed in parallel in a horizontal direction, and the ground electrode is larger than the power feeding electrode, and wherein the first antenna element is disposed in parallel to a part of the ground electrode in a vicinity of the ground electrode.

2. The window glass according to claim 1, further comprising:

a shielding film that is formed in a peripheral region of the window glass, wherein the shielding film includes a protruding portion that protrudes from an area, along an upper edge of the window, of the peripheral region toward central area of the window glass, wherein at least a part of the pair of the electrodes of the glass antenna is formed on the shielding film.

3. The window glass according to claim 2, wherein, in the protruding portion of the shielding film, an upper edge is long, a lower edge is short, and one of side edges has a linear shape or a curved shape, and wherein the third antenna element extends toward the one of the side edges of the protruding portion of the shielding film.

4. The window glass according to claim 2, wherein the fourth antenna element and the fifth antenna element form a straight line, and wherein a lower end of the straight line is closest to the second antenna element, and wherein the straight line extends such that, as a point on the straight line moves upward, a distance between the point and the second antenna element becomes greater.

5. The window glass according to claim 1, further comprising:

a resistor that connects the ground electrode and the power feeding electrode.

6. The window glass according to claim 5, wherein, in the ground electrode, or in each of the ground electrode and the power feeding electrode, a punched part is formed at a position that does not contact the resistor.

7. The window glass according to claim 1, further comprising:

a cover that covers at least a part of the pair of the electrodes of the glass antenna and a resistor that connects the pair of the electrodes.

8. The window glass according to claim 1, wherein a plurality of the glass antennas are provided, while the plurality of glass antennas are separated by a predetermined distance.

9. The window glass according to claim 1, wherein the third antenna element is directly connected to the power feeding electrode.

10. A window glass for a vehicle, the window glass including a glass antenna for transmitting and receiving communication waves, the glass antenna comprising:

a pair of electrodes that are a ground electrode and a power feeding electrode;

a first antenna element that is connected to the power feeding electrode;

a second antenna element that is connected to the power feeding electrode, and that extends approximately downward, wherein the second antenna element is longer than the first antenna element;

a third antenna element that is connected to the power feeding electrode, and that extends in a direction other than the direction in which the second antenna element extends, wherein the third antenna element is shorter than the second antenna element;

a fourth antenna element, wherein one end of the fourth antenna element is connected to an end portion of the third antenna element, and the other end of the fourth antenna element extends upward;

a fifth antenna element, wherein one end of the fifth antenna element is connected to the end portion of the third antenna element and the one end of the fourth antenna element, and the other end of the fifth antenna element extends downward; and a shielding film that is formed in a peripheral region of the window glass, wherein the shielding film includes a protruding portion that protrudes from an area, along an upper edge of the window, of the peripheral region toward central area of the window glass, wherein at least a part of the pair of the electrodes of the glass antenna is formed on the shielding film, wherein the protruding portion of the shielding film has a trapezoidal shape such that an upper edge is long and a lower edge is short, and wherein the fourth antenna element and the fifth antenna element form a straight line, and the straight line is parallel to one of side edges of the protruding portion having the trapezoidal shape of the shielding film.

11. A glass antenna comprising:

a pair of electrodes that are a ground electrode and a power feeding electrode;

a first antenna element that is connected to the power feeding electrode;

a second antenna element that is directly connected to the power feeding electrode, and that extends approximately downward, wherein the second antenna element is longer than the first antenna element;

a third antenna element that is connected to the power feeding electrode, and that extends in a direction other than the direction in which the second antenna element extends, wherein the third antenna element is shorter than the second antenna element;

a fourth antenna element, wherein one end of the fourth antenna element is connected to an end portion of the third antenna element, and the other end of the fourth antenna element extends upward; and a fifth antenna element, wherein one end of the fifth antenna element is connected to the end portion of the third antenna element and the one end of the fourth antenna element, and the other end of the fifth antenna element extends downward, wherein the electrodes of the pair of electrodes are disposed in parallel in a horizontal direction, and the ground electrode is larger than the power feeding electrode, and wherein the first antenna element is disposed in parallel to a part of the ground electrode in a vicinity of the ground electrode.

12. The glass antenna according to claim 11, wherein the third antenna element is directly connected to the power feeding electrode.

* * * * *